US006018970A

United States Patent [19]

Ford et al.

[11] Patent Number: 6,018,970

[45] **Date of Patent: *Feb. 1, 2000**

[54] STRETCH-FORMING MACHINE WITH SERVO-CONTROLLED CURVING JAWS

[75] Inventors: Jesse Carl Ford, Tega Cay, S.C.; Larry Alexander Polen, Matthews, N.C.

[73] Assignee: Alstom USA Inc., Hawthorne, N.Y.

[ * ] Notice: This patent is subject to a terminal disclaimer.

[21] Appl. No.: 09/177,184

[22] Filed: Oct. 22, 1998

Related U.S. Application Data

[63] Continuation of application No. 09/005,334, Jan. 9, 1998, Pat. No. 5,910,183.

[51] Int. Cl.[7] ..... B21D 11/02

[52] U.S. Cl. ..... 72/21.5; 72/296; 72/302

[58] Field of Search ..... 72/302, 296, 297, 72/20.1, 21.1, 17.2

[56] References Cited

U.S. PATENT DOCUMENTS

| | | | |
|---|---|---|---|
| 2,747,644 | 5/1956 | Wheeler . | |
| 2,824,594 | 2/1958 | Gray . | |
| 2,961,028 | 11/1960 | Bath . | |
| 3,299,688 | 1/1967 | Gray . | |
| 3,948,071 | 4/1976 | Lieberman | 72/296 |
| 4,698,995 | 10/1987 | Chorneau | 72/297 |
| 4,706,486 | 11/1987 | Kan | 72/302 |
| 4,747,292 | 5/1988 | Chorneau | 72/302 |

FOREIGN PATENT DOCUMENTS 1123763 11/1984 U.S.S.R. .

OTHER PUBLICATIONS

GEC Alsthom–Cyril Bath; "Innovative process technology for the metal forming industry"; Entire brochure; Published prior to Oct. 22, 1998.

The Cyril Bath Company; "The stretch forming process for metal parts—An illustrated explanation of stretch forming technology, applications, specifications and controls"; Entire brochure; 1984.

*Primary Examiner*—Daniel C. Crane
*Attorney, Agent, or Firm*—Adams Law Firm, P.A.

[57] ABSTRACT

A stretch-forming machine of the type wherein a pair of opposed curving jaws grips opposing ends of a metal sheet to be stretch-formed in a curved configuration. Each of the jaws are formed of an array of adjacent grippers movable relative to each other by respective hydraulic cylinders to define a part of the curve of the jaw. The improvement to the stretch-forming machine which is the subject of this application comprises a closed-loop servo-control means for moving each one of the grippers into a predetermined position relative to each other. Each of the servo-control means comprises a hydraulic cylinder position controller carried by the hydraulic cylinder of the one gripper for controlling hydraulic fluid flow to the hydraulic cylinder responsive to stored data representing the desired predetermined position of one of the grippers. A motor is provided for actuating the position controller in response to the data received by the position controller to move the hydraulic cylinder. Hydraulic cylinder position feedback means is positioned on the hydraulic cylinder for sensing the position of the hydraulic cylinder and communicating a signal representing the position of the hydraulic cylinder to the position controller.

6 Claims, 9 Drawing Sheets

STRETCH-FORMING MACHINE WITH SERVO-CONTROLLED CURVING JAWS

This application is a 37 C.F.R. §1.53(b) continuation application of U.S. Ser. No. 09/005,334 filed Jan. 9, 1998, now U.S. Pat. No 5,910,183.

TECHNICAL FIELD AND BACKGROUND OF THE INVENTION

This invention relates to a closed loop servo-controlled stretch-forming machine of the type having two opposed clamping jaws. While the term "stretch-forming" is used in this application, the invention is intended to have application to any type of metal-forming machine wherein jaws are comprised of a number of adjacent grippers which are collectively curvable so as to more closely conform to the shape to be imparted to the metal.

The clamping jaws are formed of a series of hinged grippers move relative to each other in such a manner as to collectively form concave, convex or lazy-S curves. These opposed jaws are used to grip opposing ends of a metal sheet while the sheet is stretched into its yield state and while in that state is formed over a die. Each of the grippers is actuated against a mechanical or electrical stop by hydraulic cylinders so that the gripped sheet can be loaded flat, then caused to assume a contour roughly in the shape of the curved surface of the die. Thus, use of curved jaws in a stretch-forming machine saves material that would be wasted by the transition from the straight jaw's opening to the surfaces of the curved die.

For thin sheets, the curved jaws can apply a significant secondary forming action when forming parts such as aircraft fuselage parts by "gloving" the part while in the yield state over the die prior to the final longitudinal forming action.

Each of the grippers is controlled by a hydraulic cylinder, and the collective, accumulated motion of the hydraulic cylinders of adjacent grippers defines the curve of the jaw.

Several functions of such a stretch-forming machine have heretofore been controlled by various types of servo-feedback control devices. However, in prior art stretch-forming machines with curving jaws, the stroke of the hydraulic cylinder of each of the grippers is required to be mechanically adjusted and locked by a skilled set-up technicians. Such mechanical adjustment is disadvantageous for several reasons.

First, manual, mechanical adjustment is time-consuming and subject to trial-and-error adjustment and re-adjustment. Second, safety is compromised to the ex-tent that the technician is required to work in close proximity to heavy machinery and high hydraulic pressures. Third, creeping maladjustment may occur during machine operation requiring down-time to correct. Fourth, incorrect set-up may go unnoticed, resulting in wasted time and materials.

For these reasons, servo-control of the grippers is desirable to provide for a quicker, more precise machine set-up, to provide greater safety for machine technicians, and to provide constant feedback control based upon actual gripper and jaw positions during actual machine operation.

SUMMARY OF THE INVENTION

Therefore, it is an object of the invention to provide servo-control for the jaws of a curving jaw stretch-forming machine.

It is another object of the invention to provide servo-control for the individual grippers which collectively form a curving jaw of a stretch-forming machine.

It is another object of the invention to provide servo-control for the individual grippers which collectively form a curving jaw of a stretch-forming machine during machine set-up and metal forming operations.

It is another object of the invention to provide servo-control for the individual grippers which collectively form a curving jaw in order to provide quicker and more precise machine set-up.

It is another object of the invention to provide servo-control for the individual grippers which collectively form a curving jaw in order to provide a safer work environment for machine technicians and operators.

It is another object of the invention to provide servo-control for the individual grippers which collectively form a curving jaw in order to provide more efficient and precise metal forming.

These and other objects of the present invention are achieved in the preferred embodiments disclosed below by providing a stretch-forming machine of the type wherein a pair of opposed curving jaws grips opposing ends of a metal sheet to be stretch-formed in a curved configuration. Each of the jaws are formed of an array of adjacent grippers movable relative to each other by respective hydraulic cylinders to define a part of the curve of the jaw. The improvement to the stretch-forming machine which is the subject of this application comprises a closed-loop servo-control means for moving each one of the grippers into a predetermined position relative to each other. Each of the servocontrol means comprises a hydraulic cylinder position controller carried by the hydraulic cylinder of the one gripper for controlling hydraulic fluid flow to the hydraulic cylinder responsive to stored data representing the desired predetermined position of one of the grippers. A motor is provided for actuating the position controller in response to the data received by the position controller to move the hydraulic cylinder. Hydraulic cylinder position feedback means is positioned on the hydraulic cylinder for sensing the position of the hydraulic cylinder and communicating a signal representing the position of the hydraulic cylinder to the position controller.

According to one preferred embodiment of the invention, the servo-control means is carried on the one gripper.

According to yet another preferred embodiment of the invention, the position controller comprises circuit means for summing a signal representing the desired predetermined position of one of the grippers and the signal representing the position of the hydraulic cylinder to the position controller and outputting a signal representative of any variance between the desired and actual position of the hydraulic cylinder, and valve means cooperating with blind and rod sides of the hydraulic cylinder moving the hydraulic cylinder by hydraulic fluid flow.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
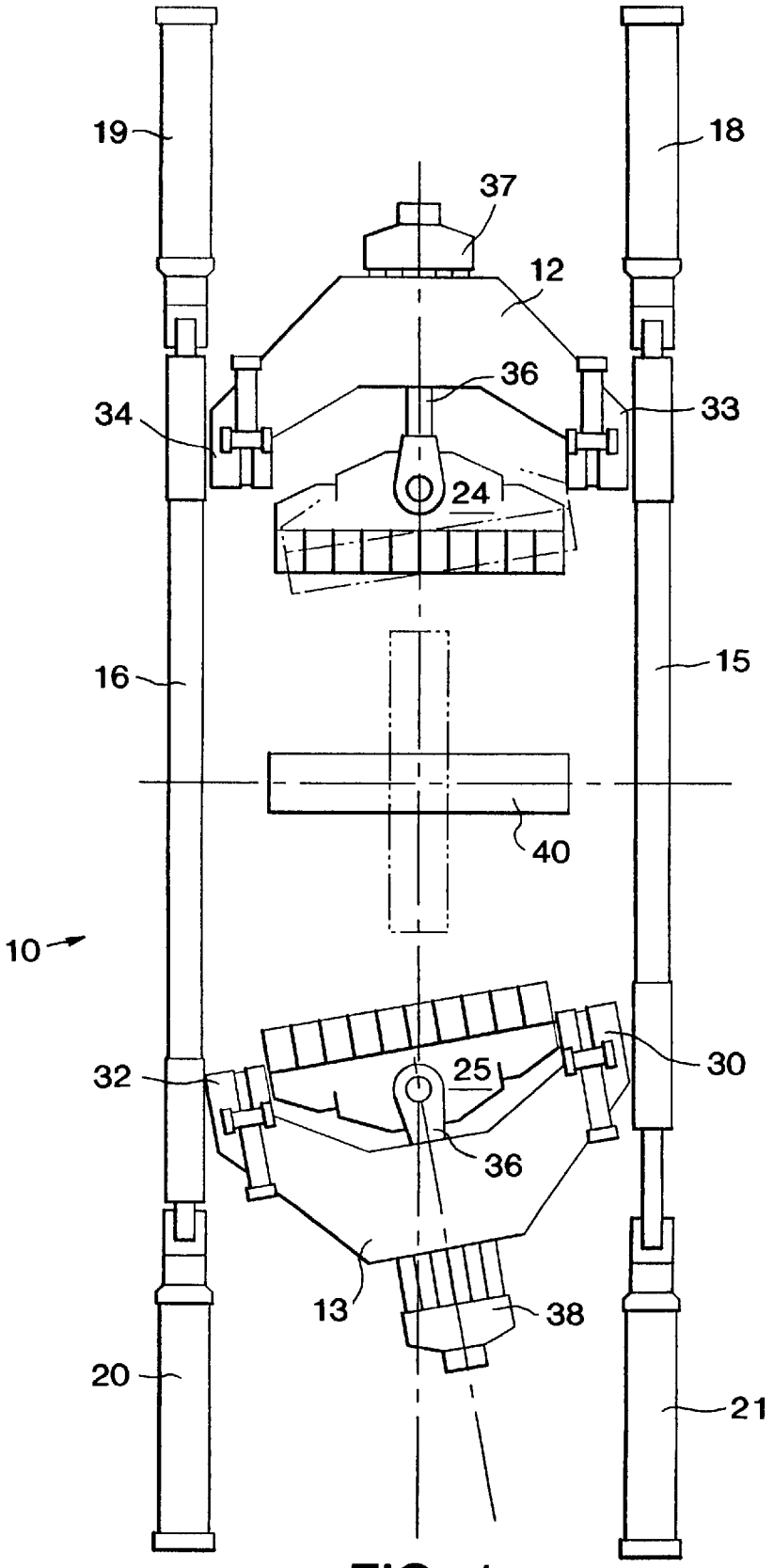
FIG. 1 is a simplified top plan view of a curving jaw stretch-forming machine of the type on which the invention of the application is utilized.
Figure 2:
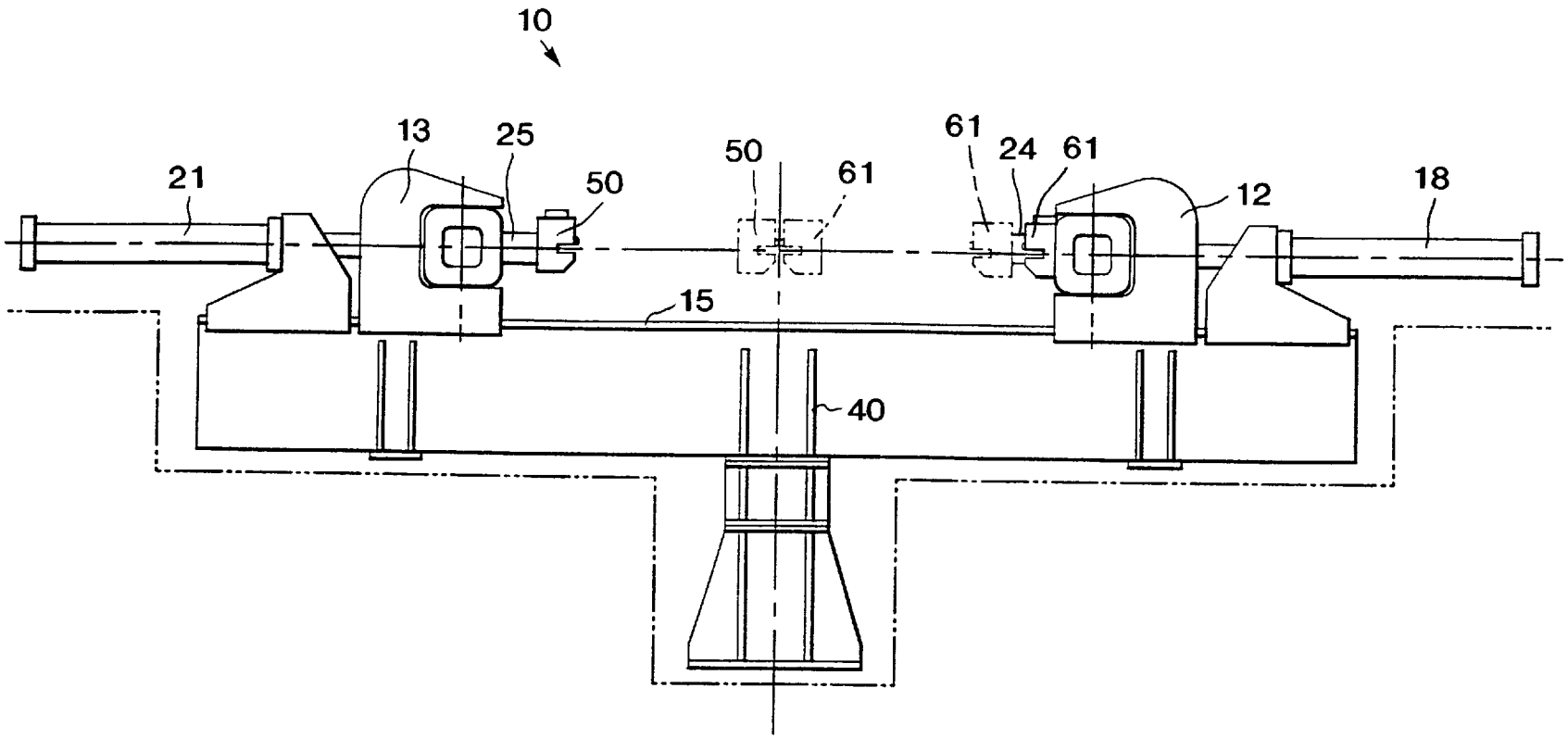
FIG. 2 is a side elevation of the stretch-forming machine shown in FIG. 1.
Figure 3:
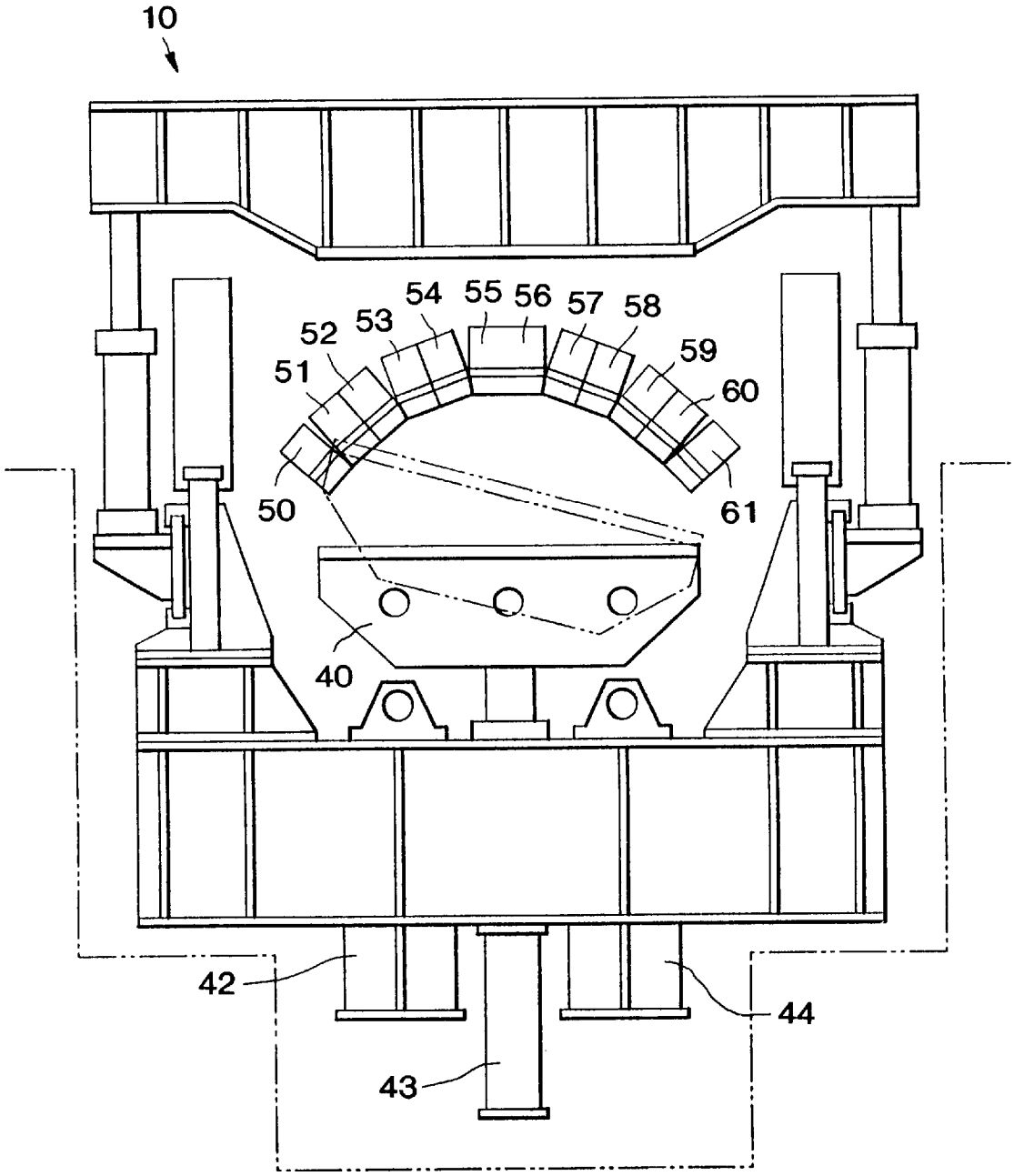
FIG. 3 is an end elevation of the stretch-forming machine shown in FIG. 1.

Referring now specifically to the drawings, a stretch-forming machine 10 according to an embodiment of the invention is shown in simplified form in FIGS. 1, 2 and 3. As generally shown, the stretch-forming machine 10 comprises a pair of yokes 12 and 13 riding on respective beam ways 15, 16 and actuated by carriage cylinders 18, 19 and 20, 21, respectively. Yokes 12 and 13 carry respective jaws 24, 25, each of which are mounted for movement on several axes.

Jaw angulation (FIG. 1) is provided by asymmetric movement of the carriage cylinders 18, 19 (jaw 24) and carriage cylinders 20, 21 (jaw 25).

Figure 4A:
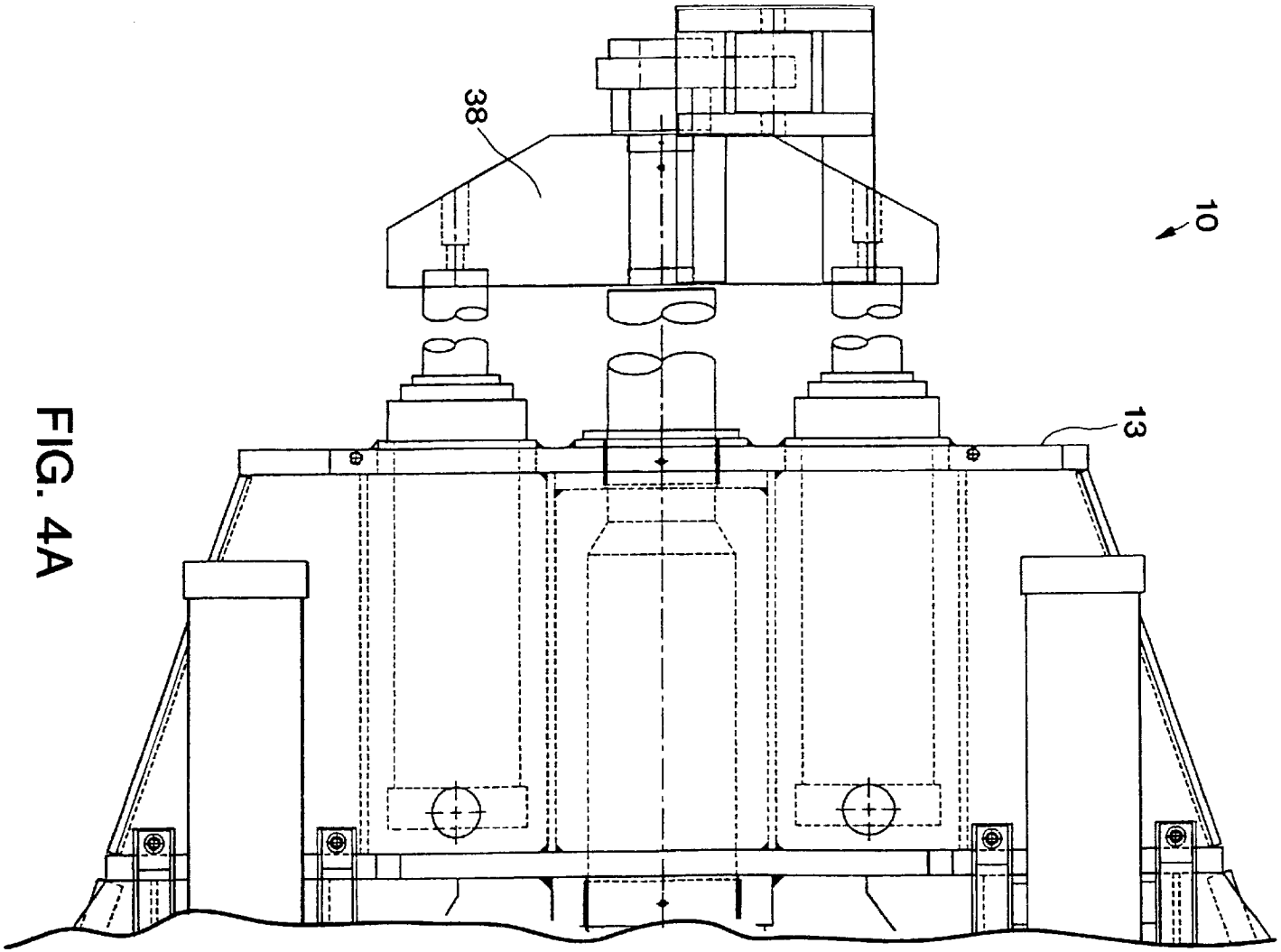
FIG. 4A is a partial, detailed top plan view, which with FIG. 4B, shows a jaw of a stretch-forming machine according to an embodiment of the invention, with some extraneous parts removed for clarity.
Figure 4B:
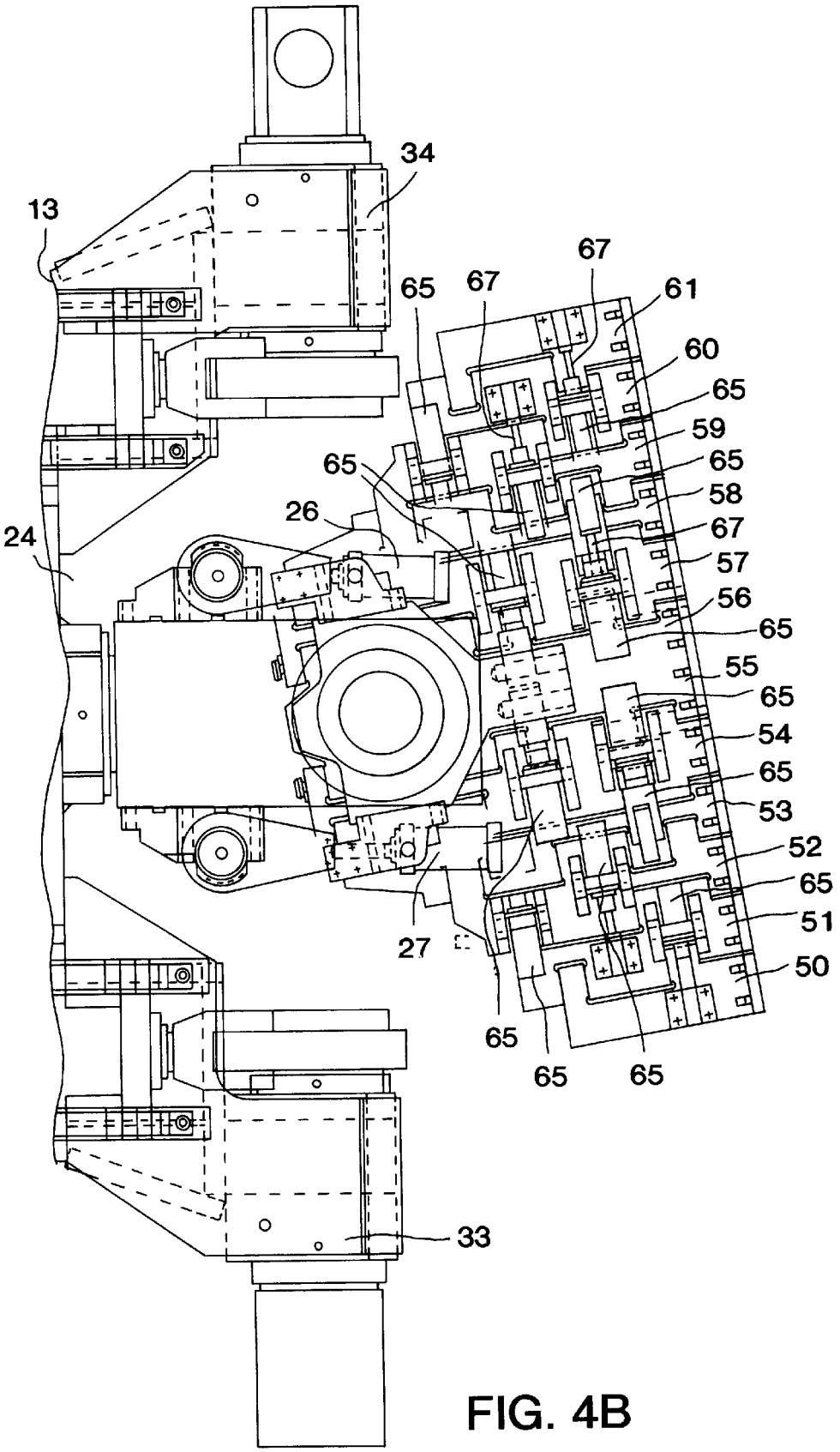
FIG. 4B is a partial, detailed top plan view, which with FIG. 4A, shows a jaw of a stretch-forming machine according to an embodiment of the invention, with some extraneous parts removed for clarity.

Oscillation of jaws 24 and 25 is provided by oscillation cylinders 26, 27 (FIG. 4B as to jaw 24) carried on the jaws 24, 25 themselves. Jaw rotation is provided by rotation cylinders 30, 31 which interconnect the yokes 12, 13 and respective jaws 24, 25 and permit the jaws 24, 25 to be rotated rotate about a longitudinal horizontal axis relative to the yokes 12, 13 during sheet loading and forming. Yoke 12 is mounted for pivoting up and down movement by transverse horizontal pivot assemblies 33, 34, as best shown in FIG. 4B. Yoke 13 is mounted and operates in an identical manner.

Tension is placed on the metal sheet by retracting the jaws 24, 25 in the yokes 12, 13 by means of respective tension cylinder assemblies 37, 38.

A centrally-positioned die table 40 is mounted for vertical movement on die table cylinders 42, 44. Stretch-forming of a metal sheet occurs as the die table 40 is moved vertically upwardly by the die table cylinders 42, 44 and the tension cylinder assemblies 37 and 38 hold the metal sheet in a tensioned condition. Vertical movement of the die table cylinders 42, 44 cause the yokes 12, 13 to pivot about the pivot assemblies 30, 32 and 33, 34.

A guide post 43 reacts to all side loading.

Asymmetric movement of the die table cylinders 42, 44, and consequent asymmetric movement of the die table 40 is accommodated by rotation of the jaws 24, 25 about the rotation pivots 31, 36.

A bulldozer assembly may be mounted above the die table 40 and for a bulldozer platen (not shown) for being moved vertically into and out of forming contact with a forming die on the die table 40 to form shapes, such as reverse curves, which would otherwise require a separate forming operation as, for example, drop hammer forming.

Figure 6:
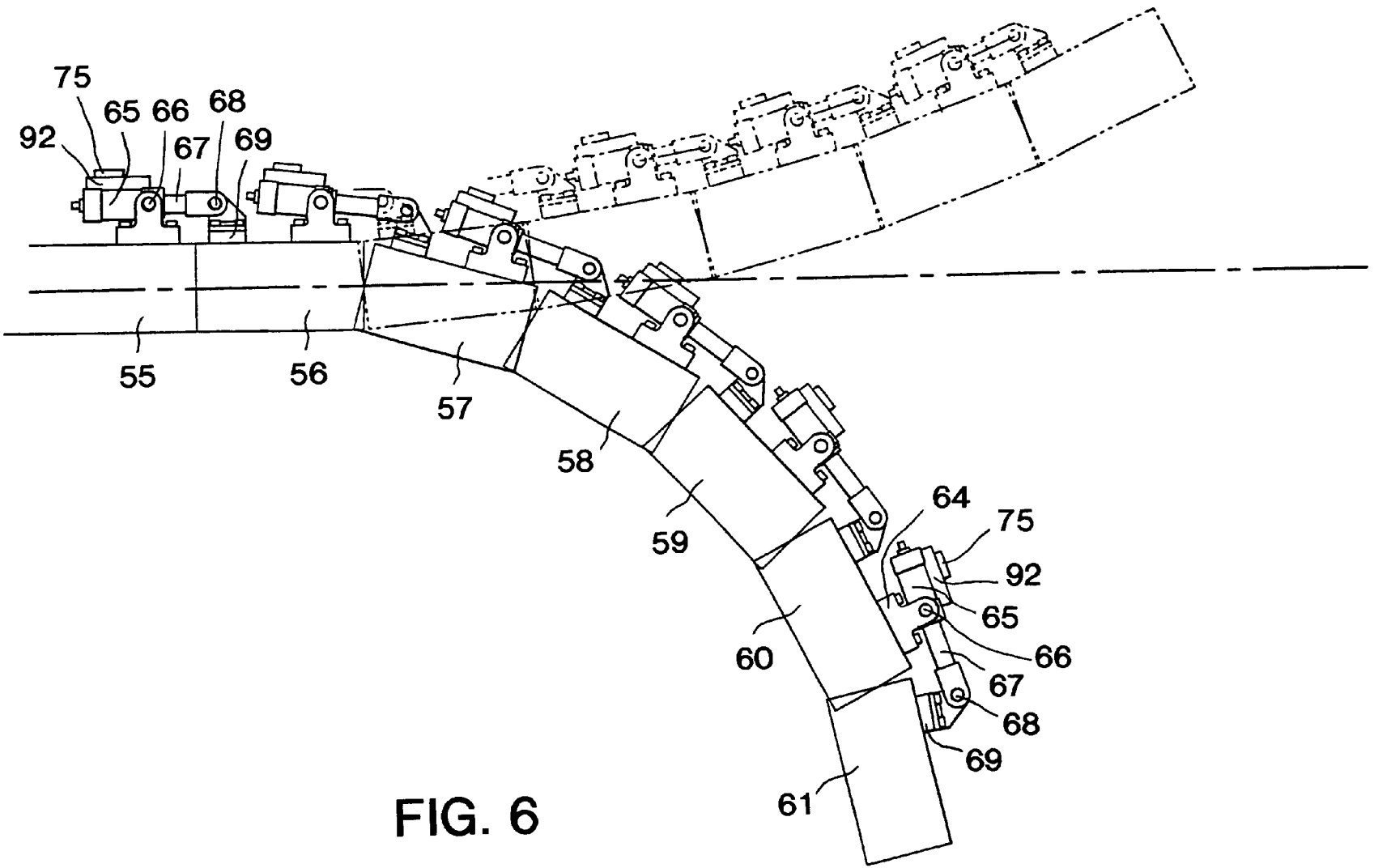
FIG. 6 is a simplified fragmentary end view of one side of a curving jaw showing the range of up and down motion of the grippers of the jaw.

As is best shown in FIGS. 1 and 3, the jaws 24 and 25 each comprise an array of adjacent grippers 50–61 into which opposing edge portions of the sheet to be formed is loaded. As is best shown in FIG. 4B and 6, these grippers are interconnected by pivots in such a manner as to permit motion relative to adjacent grippers and, as well, an accumulation of motion which results in a upwardly or downwardly-extending curved shape to the array of grippers 50–61.

Ordinarily, the grippers 50–61 are positioned in a straight configuration for sheet loading, and then hydraulically moved into a predetermined curved configuration compatible with the shape of the die over which the sheet will be stretch-formed. Prior art devices utilize mechanical stops and other devices to limit movement of grippers and thus define the degree and shape of the curve desired.

Figure 5:
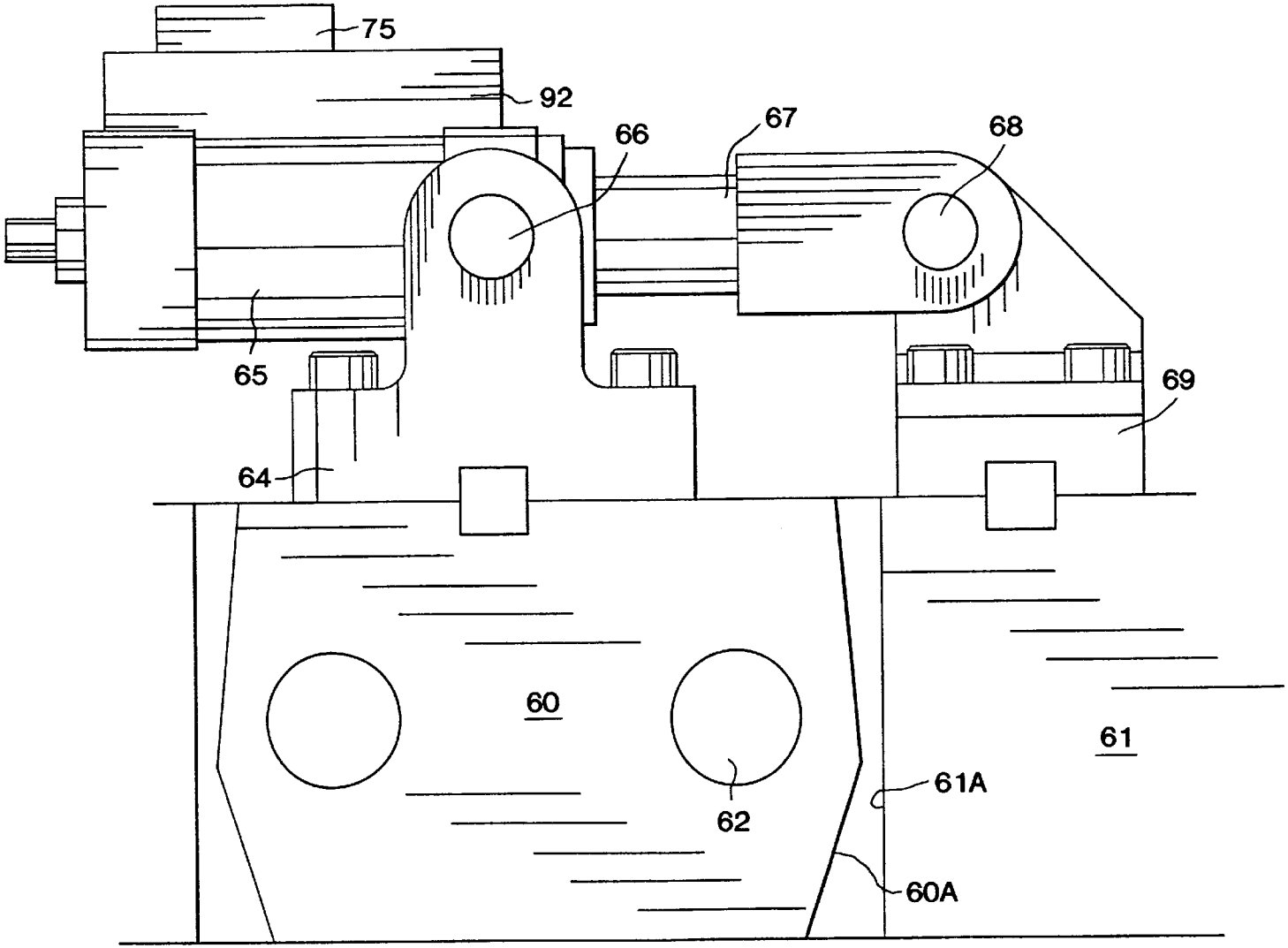
FIG. 5 is a side view, in cross-section, of a servo-control system for controlling the curving position of two adjacent grippers relative to each other.

In accordance with a preferred embodiment of the invention shown in FIG. 5, two adjacent grippers 60 and 61 are mounted for limited pivotal movement relative to each other by means of a pivot pin 62. Movement is limited by the interference angle of adjacent sides 60A and 61A of the grippers 60 and 61. In the discussion that follows it is understood that adjacent grippers cooperate in the same manner as described above with reference to grippers 60, 61. Thus, the explanation is applicable to each of the gripper pairs of grippers 50–61.

Gripper 60 carries a pillow block 64 to which a hydraulic cylinder 65 is pivotally mounted by a cylinder trunion 66. The piston rod 67 of the hydraulic cylinder 65 extends over to the adjacent gripper 61 and is pivotally connected to the gripper 61 by a clevis pin 68 pivotally mounted on a base 69.

Thus, pivotal movement of the grippers 60 and 61 relative to each other occurs by extension and retraction of the piston rod 67 of the hydraulic cylinder 65 as hydraulic fluid is pumped under pressure to the hydraulic cylinder 65.

Figure 7:
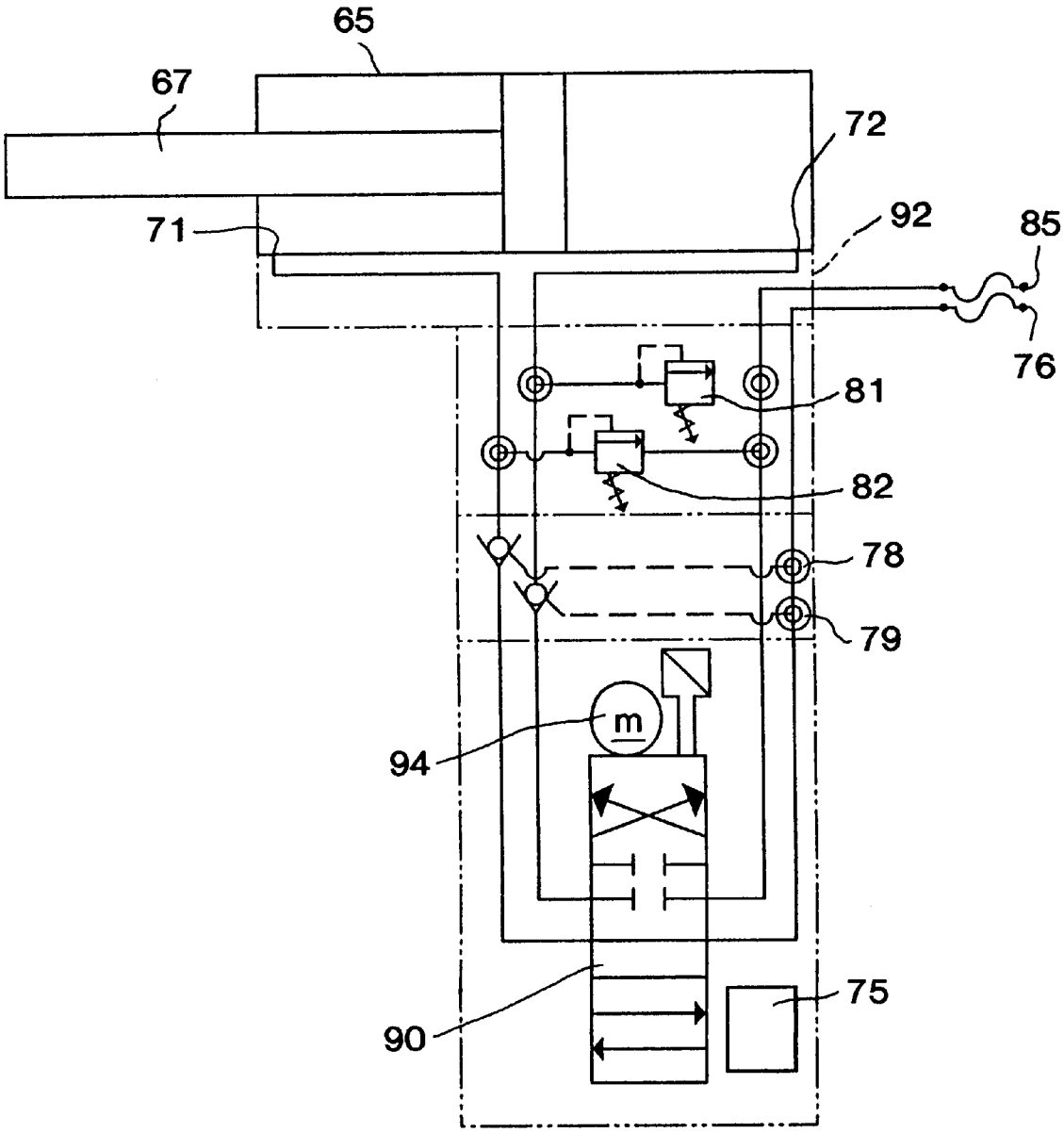
FIG. 7 is a hydraulic schematic of the servo-control system according to an embodiment of the invention.

Referring now to FIG. 7, the hydraulic cylinder 65 is supplied with hydraulic fluid through a port 71 to the rod side of the cylinder and a port 72 to the blind side. Pressurized fluid to port 71 retracts the piston rod 67 and fluid to port 72 extends the piston rod 67. As shown in FIG. 5, extension of the piston rod 67 moves the gripper 61 downwardly about pivot pin 62 relative to the gripper 60, and retraction of the piston rod 67 moves the gripper 61 upwardly about pivot pin 62. See FIG. 6. Movement of gripper 61 clockwise from the position shown in FIG. 5 results in a downward curving movement of gripper 61 relative to gripper 60. Movement of the other grippers 50–59 in the same manner results in accumulated movement which defines a curve, as shown in FIG. 6.

Referring again to FIG. 7, a servo position controller 75 directs pressure from hydraulic pump 76 which opens pilot-operated check valves 78 and 79 and allows fluid flow to port 71 or port 72. When pressure is not being supplied from the pump 76, the check valves 78 and 79 are closed and the hydraulic cylinder 65 is locked in position and cannot move.

Relief valves 81 and 82 protect the hydraulic cylinder 65 against load surges by opening ports 71 and 72 to tank 85 when an excess pressure condition is sensed.

Figure 8:
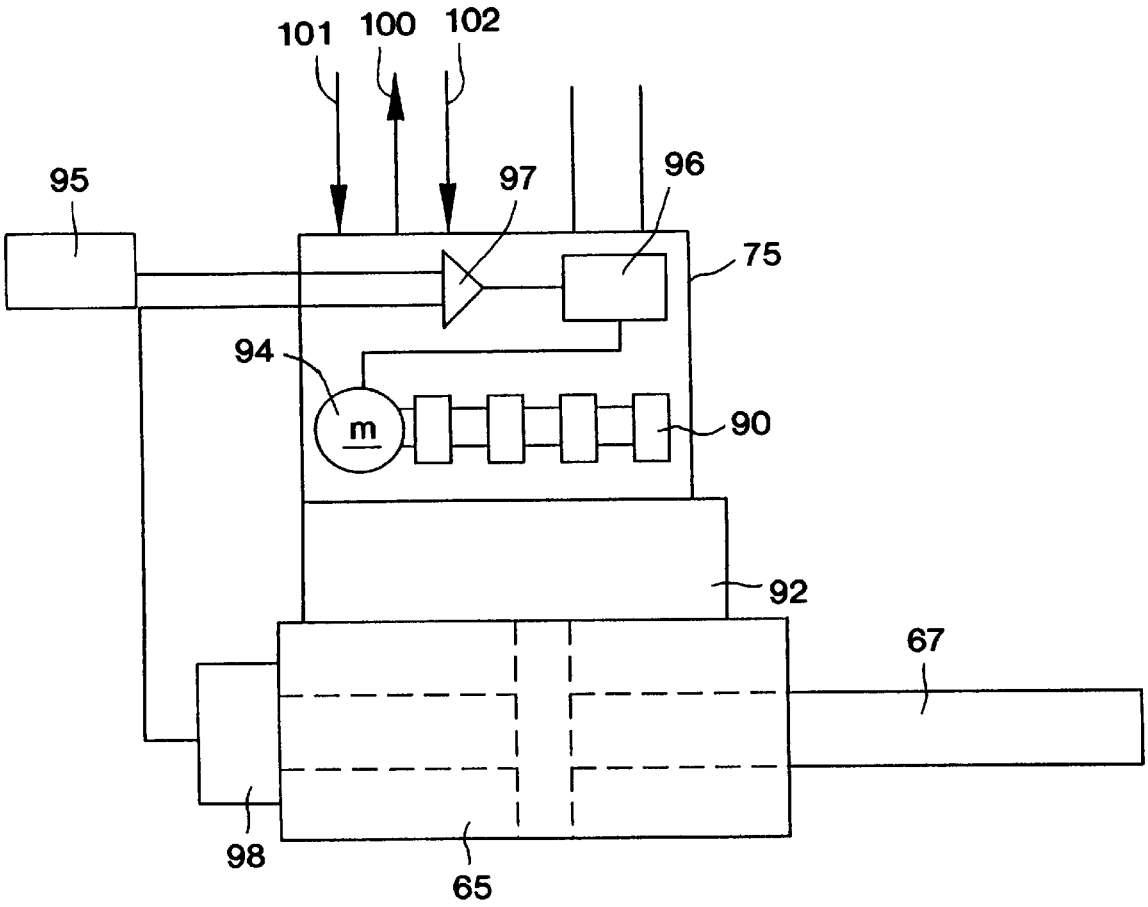
FIG. 8 is a schematic of the electronic and hydraulic systems of the servo-control system according to an embodiment of the invention.

As is also shown in FIG. 7 and in more detail in FIG. 8, hydraulic fluid is directed to ports 71 and 72 by hydraulic spool valve 90 interfaced to the hydraulic cylinder 65 by a manifold 92. An actuating driver, such as a torque motor 94 indexes the valve 90 between operative positions. A command signal from a memory source 95 represents a desired position of the hydraulic cylinder 65, and the signal is transmitted to an electronic controller 96, which includes a summing circuit 97, to the spool valve 90 which outputs a signal to motor 94. Motor 94 moves the spool valve 90 towards the desired position as the pump 76 introduces hydraulic fluid into either port 71 or 72, as required. As the piston rod 67 moves, its position is sensed by a feedback sensor 98, which outputs a signal to the summing circuit 97. A differential signal output by the summing circuit 97 to the controller 96 controls movement of the spool valve 90, which in turn controls the flow of hydraulic fluid relative to ports 71 and 72. When the command signal is nulled by the output signal from the feedback sensor 98, output of pump 76 is balanced, motor 94 ceases moving the spool valve 90, and thus movement of the hydraulic cylinder 65 ceases, and the grippers 60 and 61 are locked in their correct position relative to each other by the check valves 78 and 79. Thus, the servo function is a "closed loop" one.

The servo device described above is duplicated for each of the grippers on both jaws 24 and 25 of the stretch-forming machine 10.

A status signal output 100 provides current feedback information to an operator or main controller (not shown) regarding pressure, gripper position and the like. An auxiliary data input 101 permits special functions such as "enable" and "disable" signals to be fed to the electronic controller 96. A power input 102 provides current to motor 94 and to the other electrically-powered functions of the system.

A closed-loop servo-control means for a stretch-forming machine is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

We claim:

1. In a stretch-forming machine of the type wherein a pair of opposed curving jaws grips opposing ends of a metal sheet to be stretch-formed in a curved configuration, each of said jaws being formed of an array of adjacent grippers movable relative to each other by respective hydraulic cylinders to define a part of the curve of the jaw, the improvement comprising a closed-loop servo-controller for moving each one of said grippers into a predetermined position relative to each other, each of said servo-controllers comprising:

(a) a hydraulic cylinder position controller carried by the hydraulic cylinder of said one gripper for controlling hydraulic fluid flow to said hydraulic cylinder responsive to stored data representing the desired predetermined position of one of the grippers;

(b) said position controller comprising:

i. circuit means for summing a signal representing the desired predetermined position of one of the grippers, and said signal representing the position of the hydraulic cylinder to said position controller and outputting a signal representative of any variance between the desired and actual position of said hydraulic cylinder; and ii. valve means cooperating with blind and rod sides of said hydraulic cylinder for moving said hydraulic cylinder by hydraulic fluid flow.

2. In a stretch-forming machine according to claim 1, and comprising actuating driver means for actuating said position controller in response to the data received by said position controller to move said hydraulic cylinder.

3. In a stretch-forming machine according to claim 2, wherein said actuating driver means comprises a motor.

4. In a stretch-forming machine according to claim 3, wherein said motor includes a proportional valve.

5. In a stretch-forming machine according to claim 1, and comprising hydraulic cylinder position feedback means positioned on said hydraulic cylinder for sensing the position of the hydraulic cylinder and communicating a signal representing the position of the hydraulic cylinder to said position controller.

6. In a stretch-forming machine according to claim 1, wherein said servo-controller is carried on said one gripper.

* * * * *